US008991093B1

(12) United States Patent
Calvert

(10) Patent No.: US 8,991,093 B1
(45) Date of Patent: Mar. 31, 2015

(54) UNDERWATER FIREARM SYSTEM

(71) Applicant: UFS Associates, Trustee for Underwater Firearm System CRT Trust, Manassas, VA (US)

(72) Inventor: S. Mill Calvert, Manassas, VA (US)

(73) Assignee: UFS Associates, Trustee for Underwater Firearm System CRT Trust, Manassas, VA (US)

( * ) Notice: Subject to any disclaimer, the term of this patent is extended or adjusted under 35 U.S.C. 154(b) by 0 days.

(21) Appl. No.: 14/341,780

(22) Filed: Jul. 26, 2014

(51) Int. Cl.
*F41C 9/06* (2006.01)
*F41A 35/02* (2006.01)
*F41A 21/32* (2006.01)

(52) U.S. Cl.
CPC .. *F41A 21/32* (2013.01); *F41C 9/06* (2013.01)
USPC ..... 42/114

(58) Field of Classification Search
CPC ..... F41C 9/06; F41A 35/02; F41A 21/32
USPC ..... 42/1.14, 96
See application file for complete search history.

(56) References Cited

U.S. PATENT DOCUMENTS 2,543,766 A * 3/1951 Davis, Jr. ..... 89/16
3,701,371 A * 10/1972 Stackhouse ..... 206/317
4,077,147 A 3/1978 Donnard et al.
4,817,322 A * 4/1989 Dietz et al. ..... 42/96
5,105,571 A * 4/1992 Kinchin et al. ..... 42/96
5,600,912 A 2/1997 Smith
5,639,982 A 6/1997 Cipolla
5,678,344 A * 10/1997 Jones et al. ..... 42/96
6,516,550 B1 * 2/2003 Schnyder et al. ..... 42/96
7,185,607 B1 * 3/2007 Pearson ..... 42/96
2003/0005614 A1 * 1/2003 Cossio ..... 42/96
2008/0110076 A1 * 5/2008 Bennett et al. ..... 42/96
2011/0000122 A1 * 1/2011 Camarillo ..... 42/96
2011/0041376 A1 * 2/2011 Brensinger ..... 42/96
2014/0013639 A1 * 1/2014 Polovnev et al. ..... 42/1.14

* cited by examiner

*Primary Examiner* — Bret Hayes
(74) *Attorney, Agent, or Firm* — Louis Ventre, Jr.

(57) ABSTRACT

An underwater firearm system includes a gun; a sealable plastic bag; a tube; and a plastic material sealing the tube. The sealable plastic bag seals in the firearm and keeps it dry when moved underwater. The sealable plastic bag is configured to enable a shooter to hold the firearm therein placed and pull the trigger, which for example may include a finger cavity that extends through the trigger guard so that a shooter's finger may be inserted into the tubular cavity to engage the trigger. The tube has an inner dimension at least as large as the bore of the gun. The plastic material seals the tube against the inflow of water when the tube is moved underwater. A removable watertight cap optionally fits over the barrel and plastic bag at the muzzle to reseal the sealable plastic bag after having been breached by discharge of the firearm.

3 Claims, 2 Drawing Sheets

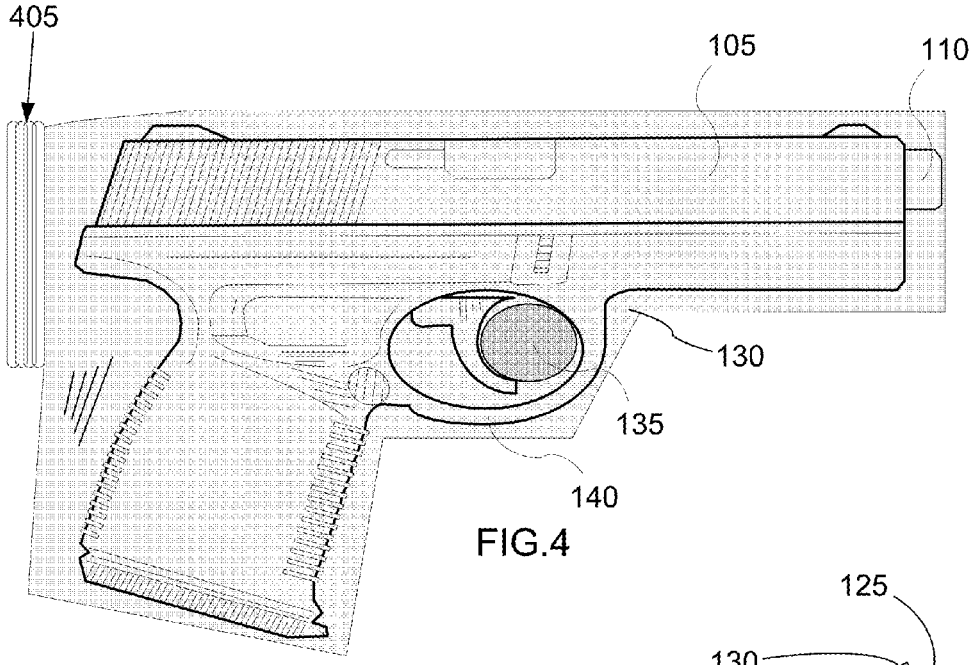
FIG.4
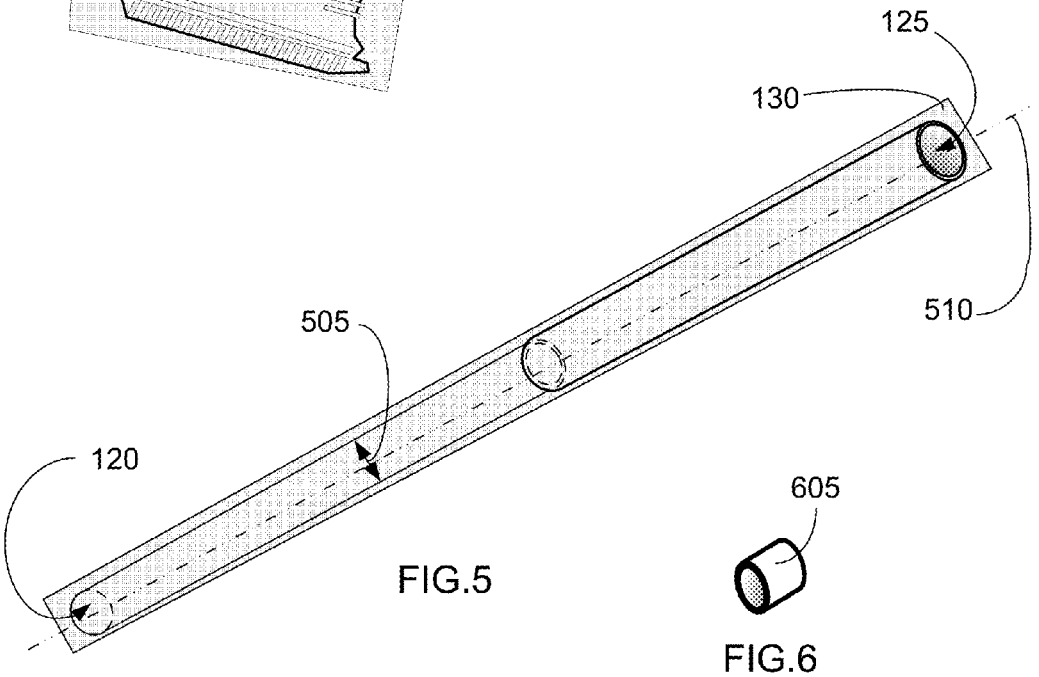
FIG.5
FIG.6

UNDERWATER FIREARM SYSTEM

TECHNICAL FIELD

In the field of firearms, an underwater firearm system includes a barrel extender comprising a water-excluded tubular attachment to a water-excluded firearm barrel to enable use of a firearm underwater.

BACKGROUND ART

Existing underwater hand weapons for swimmers typically use rubber bands or a variety of mechanical springs, compressed gas, and hydraulic accumulators to propel a spear. Less common are propellant fired weapons, but at least one designer has proposed a specially designed watertight gun that fires a spike with a sealed in propellant.

Even though the majority of our beautiful earth is made up of a vast expanse of never ending oceans, man over the ages has focused most of his technology development on land based inventions and has put little thought into underwater firearm technology. One area that has been overlooked is underwater firearm technology where the firearm is the same weapon used above the water level.

SUMMARY OF INVENTION

An underwater firearm system includes a firearm, i.e. a gun; a sealable plastic bag; a tube; and a plastic material sealing the tube. The sealable plastic bag seals in the gun and keeps it dry when moved underwater. The sealable plastic bag is configured to enable a shooter to hold the gun in the usual manner and pull the trigger while the gun remains in the bag. The bag may include a finger cavity that extends through the trigger guard so that a shooter's finger may be inserted into the tubular cavity to engage the trigger. The tube has two open ends, which include a muzzle-end that fits over the barrel of the firearm, and an exit-end where the bullet exits. The tube has an inner dimension in any direction at least as large as the bore of the gun. The plastic material seals the tube against the inflow of water when the tube is moved underwater. A removable watertight cap optionally fits over the barrel and plastic bag at the muzzle to reseal the bag after having been breached by discharge of the firearm.

Technical Problem

Various military personnel that conduct operations on the water have no simple reliable firearms technology they can use. While on land, they of course have their standard-issue semi-automatic service pistol which is usually of the 1911 style design. If they have to swim through the water to reach a mission target, their guns can become soaked in salt water which may have ramifications as to whether it will still properly function on land after they reach their target destination.

While in the water, military and other divers have no workable firearm that can properly fire underwater. This missing capability creates potentially great danger if the divers encounter enemy divers or large killer sharks. There is a need for a technology that enables underwater effective use of a standard-issue service firearm, such as a semi-automatic or revolver. Having a firearm fire and work properly under water is a problem not previously solved.

All the nay-sayers would, of course, say this is an impossible dream because everyone knows that a bullet fired under water will only go a number of inches before the water resistance completely stops it, or sends it in unpredictable directions. They will tell you even ballistics labs fire a bullet into a bucket of water because the water stops it quickly. Thus, it is said that it is practically impossible to effectively use a firearm while under water.

If only there was a new creative technology that enabled our military personnel to use and properly fire their service weapon underwater. This would open up a whole new world of offensive and defensive protection that our Navy Seals and underwater commandos could take advantage of. No longer would they be relegated to brutal underwater hand-to-hand combat with a knife.

If we are going to wish for new underwater firearm technology, it would be good also if it kept the pistol dry so the damaging effects of salt water could not take a toll on both the weapon and its ammo.

Solution to Problem

The underwater firearm system enables our soldiers to carry their standard-issue service weapon underwater in a totally dry protected state, and to fire the weapon underwater to shoot and kill either an enemy diver or a large killer shark.

The flexible plastic weapon bag in the underwater firearm system can be thought of as specially-designed disposable zip-lock type sandwich bag that is designed to enable a gun to remain dry and be fully functional with room for all moving parts to operate.

The flexible plastic weapon bag preferably has the approximate shape of the gun and after the gun is placed inside the bag, the bag preferably has a waterproof-type closing seam to withstand water pressure and keep the inside of the bag dry.

The bag preferably has a molded trigger cavity whereby a finger can fit into the cavity and thence through the trigger guard to easily pull the trigger when desired. The bag preferably has an accordion-style plastic fold or extension that gives the slide of a semi-automatic pistol room to move backward and forward.

On the side of the bag by the slide, there is preferably an expandable pocket that can catch and accumulate ejected shell casings.

On the front of the bag there is preferably plastic that is conformed to fit over the muzzle of the gun.

When the gun is sealed in the bag, it is protected from water and particulate infiltration, so a Navy Seal could rise up out of the water and fire the gun just as if there were no protector bag.

In order for the underwater firearm system to enable the gun to be fired underwater without losing any ballistics, the bullet travels through one or more barrel extender tubes that are also protected from water infiltration. The tube enables the bullet to travel through air or a low-pressure environment so the bullet encounters no water resistance. The bullet is only traveling through air, or an evacuated tube which provides even better ballistics then when fired through the air.

The extender tubes are water tight. They preferably have flexible plastic membranes on the ends so they can be easily slid together to make a longer extension. When the barrel tube is slid onto the barrel of the gun, the plastic from the gun bag that covers the barrel and the flexible plastic membrane of the tube are not punctured, so the gun remains dry in the bag and the inner volume of the extender tube remains dry.

Advantageous Effects of Invention

The creative spirit of invention and possibility thinking has now solved the problem with the invention of the underwater firearm system.

This underwater firearm system enables the bullet fired underwater to have the same velocity and stopping power as a bullet fired from the weapon while on dry land.

The underwater firearm system works to protect the weapon by having it inside of a flexible, specially-designed, water tight weapon bag.

The underwater firearm system technology virtually eliminates water resistance on the bullet.

The Navy Seal can decide how long to make the extender barrel and just push together extender sections. He can then slide the extender unit over the barrel. When he goes to fire his weapon, he just pushes the end of the extender barrel against his target and pulls the trigger. The bullet will enter his selected enemy target with as much force and power as any firearm fired on dry land. He now has a fully functional service weapon that he can fire with deadly force either above or below the water.

Mankind has now brought "Samuel Colt's Great Equalizer" to the vast and beautiful underwater realm of our planet. No longer can the negative thinkers say it is impossible to use a firearm under water.

BRIEF DESCRIPTION OF DRAWINGS

The drawings illustrate preferred embodiments of the underwater firearm system according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

FIG. 4 is a side elevation view of a firearm within the sealable plastic bag with the tubular cavity extending through the trigger guard.

FIG. 5 is a perspective view of a telescoping tube surrounded by a plastic enclosure.

FIG. 6 is a perspective view of a removable watertight cap used to reseal the sealable plastic bag after the firearm is discharged.

DESCRIPTION OF EMBODIMENTS

Figure 1:
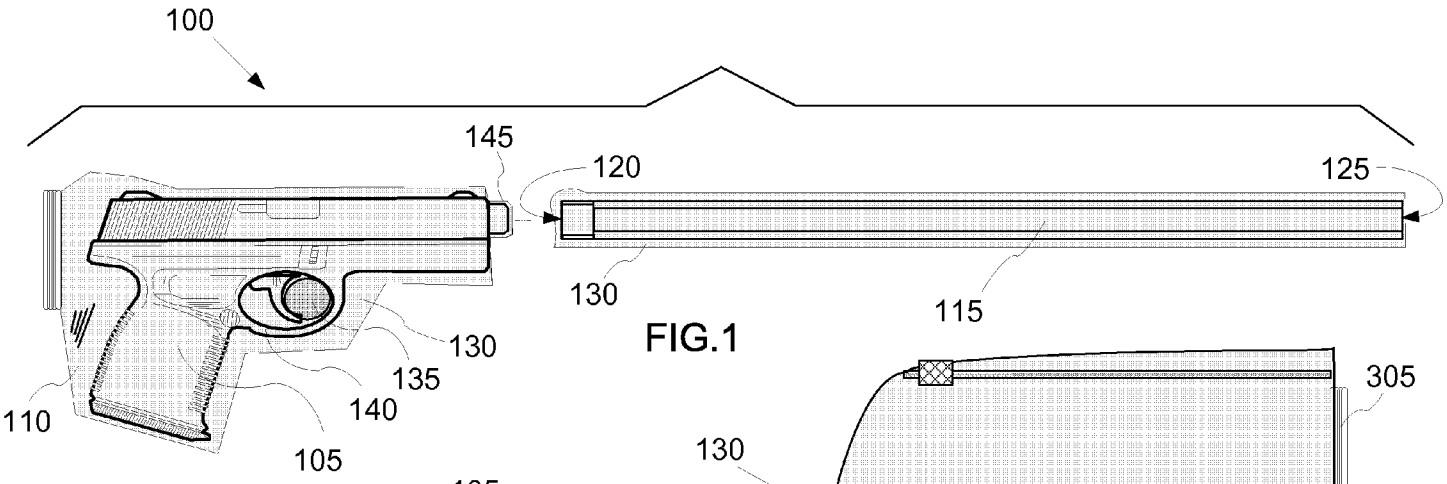
FIG. 1 is an exploded side view of a preferred embodiment of the underwater firearm system.
Figure 3:
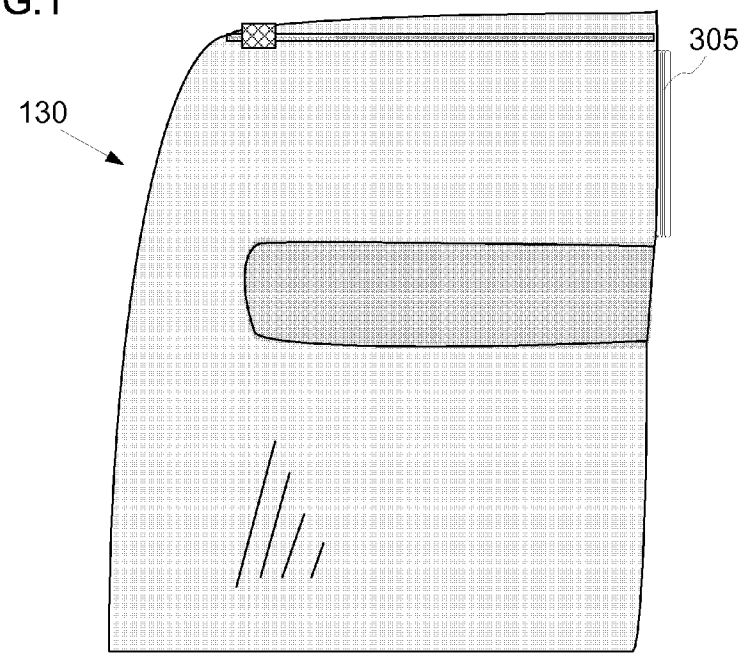
FIG. 3 is an end elevation view of a sealable plastic bag with a tubular cavity for a shooter's finger.

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made without departing from the scope of the present invention.

An underwater firearm system (100) includes a firearm (105); a sealable plastic bag (110); a tube (115); and a plastic material (130) sealing the tube (115).

Figure 2:
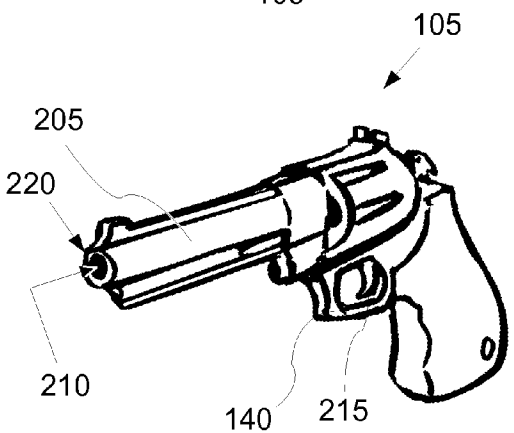
FIG.2 Prior Art
FIG. 2 is a perspective of a firearm illustrating components thereof.

The firearm (105) includes a barrel (205). The barrel (205) defines a bore (210). The firearm (105) further includes a trigger (215) and a muzzle. The muzzle (220) is defined by a last point of contact between the barrel (205) and a projectile discharged from the firearm (105). The firearm (105) may be any portable gun. Preferably, the firearm (105) is a pistol such as a semi-automatic as shown in FIG. 1, or a revolver as shown in FIG. 2. Alternatively, the firearm (105) may be a rifle.

The sealable plastic bag (110) encloses the firearm (105) therewithin. Preferably, the sealable plastic bag (110) can be easily opened and resealed so that the firearm (105) can be placed in the sealable plastic bag (110) prior to a dive underwater and then easily removed from the sealable plastic bag (110) when the shooter leaves the water. The firearm (105) is placed within the sealable plastic bag (110) so that the firearm (105) remains dry when moved underwater.

The sealable plastic bag (110) must be sufficiently roomy inside so that the firearm (105) can be grasped and fired by a shooter while the firearm (105) is within the sealable plastic bag (110). Thus, the sealable plastic bag (110) has room therewithin to enable a shooter to hold the firearm (105) therein placed and, while holding the firearm (105) therein placed to enable the shooter's finger to pull the trigger (215).

Preferably, the sealable plastic bag (110) defines a tubular cavity (135) extending into the sealable bag such that a shooter's finger may be inserted into the tubular cavity (135) to engage the trigger (215). The tubular cavity (135) permits the shooter to easily engage the trigger within a trigger guard (140) without overly stretching or stressing the sealable plastic bag (110). There may be more than one tubular cavity (135). For example, the tubular cavity (135) may extend from both sides of the sealable plastic bag (110) to accommodate a left-handed or right-handed shooter.

Preferably, the sealable plastic bag (110) also has an accordion fold (405) that stretches out to provide expansion room so that when the slide on a semi-automatic pistol moves backward when a cartridge is fired, it does not breach the sealable plastic bag (110) at a location other than in front of the muzzle (220). A similar pocket or expansion pouch may be defined within the sealable plastic bag (110) to catch spent cartridges ejected from the semi-automatic's ejection port. Thus, on the side of the bag by the slide, there is preferably an expandable pocket (305) that can catch and accumulate ejected shell casings.

On the front of the bag there is preferably a plastic pouch (145) that conforms to fit, preferably tightly, over the barrel (205) at the muzzle (220).

The tube (115) is a hollow pipe, preferably a cylindrical body, although a square or other cross-sectional shape may be employed. The tube (115) is preferably made of plastic or alternatively made of metal, or carbon fiber, or other material. A light-weight and strong material is preferred having sufficient strength that it does not breach from muzzle blast. The tube (115) may be evacuated to form a partial vacuum. A vacuum within the tube (115) enables the bullet to travel through the tube in a low-pressure environment so that the bullet encounters little resistance when traveling through the tube (115).

The tube (115) has two open ends, which are defined as a muzzle-end (120) and an exit-end (125). The muzzle-end (120) is so named because in use, the muzzle-end (120) fits over the barrel (205) of the firearm (105) to abut the muzzle (220). Abutting the muzzle (220) means that the tube (115) is immediately adjacent to, and preferably in contact with the muzzle (220) when installed on the firearm (105). The tube (115) does not have to be of uniform dimension from muzzle-end (120) to exit-end (125). For example, the tube (115) may be larger at the muzzle-end (120) and shaped to fit over the barrel (205) or attach to the firearm (105) around the barrel (205). Preferably, the part of the tube (115) butting up against the muzzle (220) is at least as large as the bore in any surrounding dimension. If the firearm (105) has a threaded end for a silencer, the tube (115) may be threaded to mate with the threads on the firearm (105). For this embodiment, the plastic material (130) on the muzzle-end (120) would preferably be placed internally within the tube (115) near where the tube (115) abuts to the muzzle (220). Alternatively, the tube (115) may simply be held in place at the muzzle (220) by the shooter when immediate use is desired.

The tube (115) may be configured to daisy chain one or more additional tubes together to form a longer tube. Alternatively, the tube (115) may be a telescoping member as shown in FIG. 5, so that it may be easily carried and deployed by the shooter.

The tube (115) has an inner dimension (505) in any direction that is at least as large as the bore (210). This inner dimension is any dimension within the hollow part of the tube (115), whether it be a diameter for a cylindrical tube or a length or width for a square or rectangular tube. This minimum inner dimension is so that a bullet exiting the barrel (205) will pass through the tube (115) with minimal interference from the inner wall of the tube (115).

The tube (115) defines an axis (510) from the muzzle-end (120) to the exit-end (125) within the tube (115). The axis (510) is essentially a longitudinal centerline of the hollow volume within the tube (115). The axis (510) is aligned with the bore (210) when the muzzle-end (120) is fitted over the barrel (205).

The plastic material (130) seals the tube (115) so that the tube (115) where it abuts the muzzle (220) remains sealed against the inflow of water when the tube (115) is moved underwater. As examples, the plastic material (130) may be another plastic bag surrounding the tube (115); it may be a small plastic strip adhered to the part of the tube (115) abutting the muzzle and a second small plastic strip adhered to the exit-end (125) of the tube (115); or it may be plastic sheeting glued over each of the two open ends of the tube (115). The plastic material (130) keeps the water out of the hollow part of the tube (115) that abuts the muzzle (220) when the tube (115) is taken below the surface of the water by a diver. The plastic material (130) is attached with sufficient play or flexibility so that it will not interfere or break when fitting the muzzle-end (120) of the tube (115) over the barrel (205).

The underwater firearm system (100) may also include a removable watertight cap (605) fitting over the barrel (205) and plastic bag at the muzzle (220). The removable watertight cap (605) may be used to reseal the sealable plastic bag (110) after having been breached by discharge of the firearm (105). Preferably, the removable watertight cap (605) is attached when the system is above the water line so that it does not seal in water within the sealable plastic bag (110) or within the firearm (105). The removable watertight cap (605) is preferably made of a thin plastic material that will easily rupture when the firearm (105) is discharged.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. An underwater firearm system comprising:

a firearm comprising: a barrel, the barrel defining a bore; a trigger; and a muzzle, the muzzle defined by a last point of contact between the barrel and a projectile discharged from the firearm;

a plastic bag within which the firearm is sealed so that the firearm remains dry when moved underwater, the plastic bag having room therewithin to enable a shooter to hold the firearm therein placed and, while holding the firearm therein placed to enable the shooter's finger to pull the trigger;

a tube having two open ends, the two open ends comprising a muzzle-end and an exit-end, the muzzle-end fitting over the barrel to abut the muzzle, the tube comprising an inner dimension in any direction at least as large as the bore, the tube further defining an axis from the muzzle-end to the exit-end, the axis aligned with the bore when the muzzle-end is fitted over the barrel; and a plastic material sealing the tube so that where the tube abuts the muzzle remains sealed against an inflow of water when the tube is moved underwater.

2. The underwater firearm system of claim 1, wherein the plastic bag defines a tubular cavity extending into the plastic bag such that a shooter's finger may be inserted into the tubular cavity to engage the trigger.

3. The underwater firearm system of claim 1, further comprising a removable watertight cap fitting over the barrel and plastic bag at the muzzle to reseal the plastic bag after having been breached by discharge of the firearm.

* * * * *